US009545660B2

(12) United States Patent
Burgin et al.

(10) Patent No.: US 9,545,660 B2
(45) Date of Patent: Jan. 17, 2017

(54) METHOD FOR PRODUCING A FORMED PART FURNISHED WITH A THROUGH HOLE

(75) Inventors: Christian Burgin, Gelterkinden (CH); Thomas Christoffel, Wittnau (CH); Andreas Matt, Murg (DE); Patrick Stemmelin, Moernach (FR); Mihai Vulcan, Hofstetten (CH)

(73) Assignee: Hatebur Umformmaschinen AG, Reinach (CH)

( * ) Notice: Subject to any disclaimer, the term of this patent is extended or adjusted under 35 U.S.C. 154(b) by 780 days.

(21) Appl. No.: 13/511,532

(22) PCT Filed: Nov. 26, 2010

(86) PCT No.: PCT/CH2010/000301
§ 371 (c)(1),
(2), (4) Date: May 23, 2012

(87) PCT Pub. No.: WO2011/063542
PCT Pub. Date: Jun. 3, 2011

(65) Prior Publication Data

US 2012/0266643 A1 Oct. 25, 2012

(30) Foreign Application Priority Data

Nov. 30, 2009 (CH) ..... 1831/09

(51) Int. Cl.
*B21K 1/04* (2006.01)
*B21K 1/76* (2006.01)

(52) U.S. Cl.
CPC *B21K 1/04* (2013.01); *B21K 1/761* (2013.01)

(58) Field of Classification Search
CPC ..... B21J 9/06; B23D 23/04; B21K 1/761; B21K 1/04; B21D 28/12; B29C 47/0066; B29C 55/30; B29C 69/001
(Continued)

(56) References Cited

U.S. PATENT DOCUMENTS 3,648,351 A * 3/1972 Kibler ..... B21C 23/186 138/143
4,435,973 A * 3/1984 Nakazawa ..... B21J 5/08 72/327
(Continued)

FOREIGN PATENT DOCUMENTS

CN 1071610 A 5/1993
CN 101232960 A 7/2008
(Continued)

OTHER PUBLICATIONS

JP 62084849 Abstract Translation; JP 62084849 Human Translation Dated Jan. 2015.*

*Primary Examiner* — Edward Tolan
*Assistant Examiner* — Peter Iannuzzi
(74) *Attorney, Agent, or Firm* — The Webb Law Firm

(57) ABSTRACT

In order to produce a formed part furnished with a through hole, a rod material is advanced by a defined length in the direction of its lengthwise extension into a forming die through a stationary guide and then immobilised by a clamping arrangement that engages with it circumferentially. The end portion of the rod material is then axially swaged by a swaging tool and is thus shaped into a disc, the circumference of which is defined by the forming die. The disc is then penetrated axially by a dishing tool and impact extruded at the same time, the displaced material flowing between the dishing tool and the inner circumferential wall of the forming die. The formed part located in the forming die is then rotated coaxially relative to the rest of the rod material and thereby separated from the rest of the rod material by torsion shearing.

19 Claims, 8 Drawing Sheets

(58) Field of Classification Search
USPC ..... 225/102; 72/254
See application file for complete search history.

(56) References Cited

U.S. PATENT DOCUMENTS

| | | | | |
|---|---|---|---|---|
| 5,259,819 | A | 11/1993 | Lee | |
| 2007/0051156 | A1 | 3/2007 | Adachi et al. | |
| 2007/0180723 | A1 * | 8/2007 | Morgan | B21D 28/125<br>33/645 |

FOREIGN PATENT DOCUMENTS

| | | | | | |
|---|---|---|---|---|---|
| DE | 2546819 | A1 | | 4/1976 | |
| DE | 2916031 | A1 | | 10/1980 | |
| DE | 3147897 | A1 | | 6/1983 | |
| EP | 0764484 | A1 | | 3/1997 | |
| EP | 2221127 | A1 | | 8/2010 | |
| GB | 1477693 | | | 6/1977 | |
| GB | 1477693 | A | * | 6/1977 | B23D 21/14 |
| GB | 2047585 | A | * | 12/1980 | B23D 23/04 |
| JP | 55120441 | A | | 9/1980 | |
| JP | 57100835 | A | | 6/1982 | |
| JP | 5950945 | U | | 3/1984 | |
| JP | 62084849 | A | * | 4/1987 | |
| JP | 6284849 | U | | 5/1987 | |
| JP | 20019554 | A | | 1/2001 | |
| JP | 2009202230 | A | | 9/2009 | |

* cited by examiner

METHOD FOR PRODUCING A FORMED PART FURNISHED WITH A THROUGH HOLE

BACKGROUND OF THE INVENTION

Field of the Invention

The invention relates to a method for producing a formed part furnished with a through hole and to a device for carrying out the method.

Description of Related Art

Such a method is known for example from DE 31 47 897 A1. According to that document, identical annular metal parts are produced without cutting from a metallic rod material by swaging and the resulting deformation of an end portion of the rod material to form a disc, followed by axial perforation of the disc with a punch having the same cross-sectional shape as the (uncompressed) rod material, and separation from the disc of the disc core that is perforated by the punch. The disc core and the uncompressed rod material portion together constitute an integral part and the starting point for a subsequent process cycle until there is no longer enough rod material remaining to form any more formed parts and the remainder is lost as waste.

When the disc core is perforated, the shear and tensile stresses generated give rise to an undesirable fracture surface with cracks and possibly buns on the peripheral edge of the hole in the disc formed thereby, possibly necessitating reworking of the formed parts.

An object of the invention is therefore to improve a method of the type described above in such manner that the formed parts produced thereby require substantially less reworking, if any. In addition, no burrs or other deformations that would hinder the subsequent processing steps should occur at the separation sites of the rod material.

SUMMARY OF THE INVENTION

In the present context, the term "rod material" or "raw material" is understood to mean any material form having a pronounced lengthwise extension and a cross-section of any dimension that is, however, constant over the lengthwise extension. In particular, this definition thus applies to bars, rods and wires of all sizes. Circular cross sections represent the standard, but the invention is not limited thereto. The description "rod-shaped" is to be construed analogously. The term "disc" in the present context is understood to refer to any body shape whose cross sectional dimensions are amplified relative to the rod material or raw material. Flat discs having a particularly circular outer conformation represent the standard, but the invention is not limited thereto.

The essence of the invention consists in the following: In a method for producing a formed part furnished with a through hole, a rod material is advanced by a defined length in the direction of its lengthwise extension into a forming die, the inner circumferential wall of which defines the outer circumference of the annular formed part to be produced, through a stationary guide having the same cross sectional shape as the rod material, and the rod material is then immobilised axially. The portion of the rod material located inside the forming die is penetrated axially and at the same time impact extruded by at least one dishing tool, wherein the displaced material flows between the at least one dishing tool and the inner circumferential wall of the forming die. The formed part that is created in this manner and is located inside the forming die, is rotated coaxially relative to the rest of the rod material together with the forming die surrounding it and the at least one dishing tool, and the formed part is thus separated from the rest of the rod material. The formed part is then transported away.

The dishing operation and the separation of the formed part by torsion not only yields cleanly conformed formed parts, but no burrs or other deformations that would impede further processing are created on the rest of the rod material.

For the purposes of providing blanks for a subsequent forming process, for example in a cold impact extrusion process, a method for separating such blanks from rod or raw material without cutting is known from DE 25 46 819 A1, in which method the material to be separated is clamped securely in coaxial chucks on either side of the desired parting plane, and the two chucks are then counter-rotated with respect to one another, wherein the blank is sheared off from the remainder of the material. To facilitate the torsional shearing operation, the material may also be notched in the area of the parting plane.

A very similar method for separating blanks from a rod material is known from DE 29 16 031 A1. In this case, the material to be separated is also immobilised in collets or form-locking torque application elements on either side of the desired parting plane, and these devices are also rotated relative to one another. In a preferred embodiment, the torsional shearing force is supplemented by an additional shearing force that assists in shearing off the blank. The additional shearing force is derived from the torsion due to the fact that the axes of rotation of the two collets or torque application elements are aligned slightly eccentrically relative to the rod material.

Neither the method of DE 25 46 819 A1 nor that of DE 29 16 031 A1 addresses the separation of a formed part that is already essentially complete.

In an advantageous variant of the method according to the invention, the end portion of the rod material that is located inside the forming die after the rod material has been advanced into the forming die is axially swaged by at least one swaging tool while the rod material is axially immobilised, and is thus shaped into a disc whose circumference is defined by the forming die and which is subsequently penetrated axially by the at least one dishing tool.

According to a preferred embodiment of the method according to the invention, the at least one dishing tool only penetrates the disc as far as about 98-99% of its axial thickness, so that before it is separated the formed part initially remains attached to the rod material via a thin circumferential fin, which is finally sheared off by torsion. In this way, a particularly clean separation is achieved, that is to say with very little deformation, and no burrs are created on the remainder of the rod material.

In order to be able to apply to the formed part the torque necessary for separating the formed part by torsion, there must be an adequate frictional or positive lock between the forming die and the formed part located therein on the one hand and between the formed part and the dishing tool on the other hand. If a frictional lock is applied, this may be assured or improved according to an advantageous embodiment of the invention in that the forming die is constructed somewhat elastically in the radial direction. This elasticity may be adapted to particular requirements by selection of a suitable material or other provisions.

It may be particularly practical and advantageous if the formed part is subjected to an axial compression force while it is being separated from the rest of the rod material. The magnitude of the axial compression force is advantageously selected such that it assures sufficient mould filling in the edge areas of the forming die, and in the case of rotationally symmetrical formed parts the frictional force applied to the adjacent walls is of the forming die and the dishing tool is sufficient to enable the formed part to be separated by torsion.

In the method described in the cited document DE 31 47 897 A1, the rod material is held between two forging dies, which are responsible for the advance of the rod material and the swaging thereof. In this way, the length of the rod material, and thus also the number of formed parts that can be produced from a length of rod material are limited, and the unusable remainders of the rod material are lost as waste. According to a further advantageous configuration of the method according to the invention, this problem is avoided by the use of a stationary clamping arrangement to brace the rod material and secure it positionally during the deformation, and preferably also during the dishing operation and the separation operation, which clamping arrangement engages with the circumference of the rod material. In this way, the length of the rod material is not limited by a second forging die, so that long rods or practically endless rod material, which is supplied from coils for example, may also be processed, and accordingly almost no significant waste is created.

For similar reasons, the rod material is also advantageously advanced by an advancing mechanism that engages with the circumference of the rod material and can be opened and closed and is movable backwards and forwards in the longitudinal direction by driving means.

After the formed part has been separated from the rest of the rod material, it is transported away from the forming area of the forming device, and conveyed for example to a further processing stage. According to a preferred embodiment, the formed part is transported away in the forming die itself, and only removed from the forming die afterwards. To transport the formed part away in the forming die, the forming die together with the formed part is preferably moved away from the rod material, first in the lengthwise direction of the rod material and then perpendicularly to this direction. This enables a simpler construction of the entire device.

A device suitable for carrying out the method according to the invention includes advancing means and immobilising means for a rod material, a guide for the rod material, a forming die and penetration means for axially penetrating the part of the rod material that is located inside the forming die. The device is also equipped with a drive means with which the forming die, together with the rod material portion located therein, which becomes a formed part following its axial penetration, and the rest of the rod material are rotatable relative to each other, wherein the formed part can be separated from the rest of the rod material by torsion shearing.

In an advantageous design variant, the device according to the invention has at least one swaging tool for axially swaging and forming an end portion of the rod material located in the forming die.

According to an advantageous embodiment, the penetration means include a dishing tool, which is equipped with a dishing punch and a dishing sleeve surrounding the punch, via which axial compression force is applicable to the formed part inside the forming die.

The immobilising means for the rod material advantageously comprise a stationary clamping arrangement that engages with the circumference of the rod material and can be opened and closed. In this context, it is particularly expedient if the clamping arrangement is equipped with a guide tube, the interior dimensions of which are adapted to the exterior cross sectional shape of the rod material, and clamping jaws arranged parallel to the axis and disposed about the circumference thereof, which clamping jaws are movable essentially without freeplay but radially inwards and outwards in axis-parallel slots in the guide tube such that they may be brought to bear on the rod material by the application of external force. In this context, the surfaces of the clamping jaws facing towards the rod material are preferably furnished with friction enhancing structures, particularly ribs. With this preferred configuration of the clamping arrangement, it is ensured that adequate clamping pressure may be applied even if the thickness of the rod material is inconsistent, and at the same time material is prevented from being forced out from between the clamping jaws due to the compressive stress that is created in the rod material during forming, since such might lead to malfunctions or even jamming of the onward transportation of the rod material.

To facilitate insertion and removal of the rod start or rod end, particularly for thick rods, the guide tube of the clamping arrangement may be constructed in separate parts. For example, a guide tube constructed of two halves, each equipped with two clamping jaws, is conceivable. For inserting and removing the rod start or rod end, the two halves of the tube are moved apart and afterwards pressed together again gapless, to that the guide tube is fully closed during production.

According to a further advantageous configuration of the device according to the invention, the device is equipped with a die carousel in which two or more forming dies are accommodated. With this die carousel, the forming die containing the formed part is able to be transported away from the forming area and replaced with an empty forming die for the next forming operation easily and efficiently.

Alternatively, linear die transport mechanisms are also conceivable.

The method according to the invention and the device according to the invention are both usable throughout the entire temperature range for cold to hot forming.

BRIEF DESCRIPTION OF THE DRAWINGS

In the following, the method and device according to the invention will be described in greater detail with reference to the accompanying drawings and on the basis of an embodiment thereof. The drawings show.

DETAILED DESCRIPTION OF THE PREFERRED EMBODIMENT(S)

Figure 1:
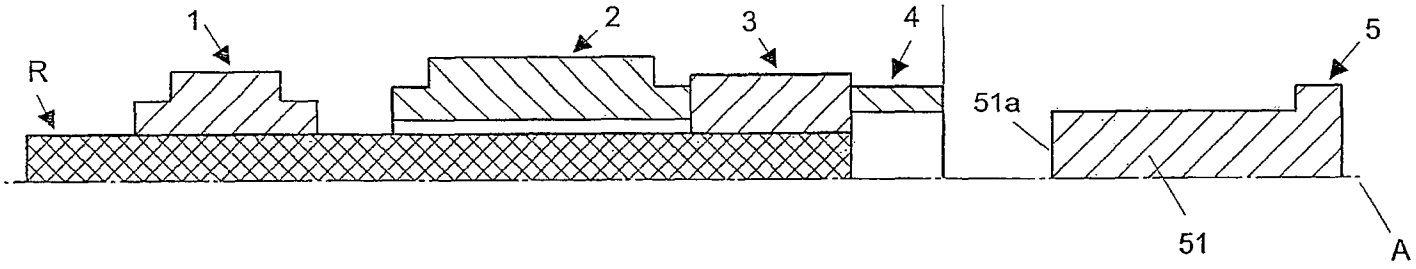
FIG. 1-13—the essential parts of the device according to the invention in thirteen typical method phases.

The following is a purely exemplary description of the production of flat, annular formed parts using rod material or raw material having a circular cross section.

The following applies for the description below: If reference numbers are shown in a figure for the purposes of illustrative clarity, but these reference numbers are not referred to in the text of the description associated directly with the figure, reference is made to the explanation thereof in previous or subsequent passages of the description. Conversely, in order to avoid presenting too much detail in a given figure, reference numbers of lesser importance for the understanding are not shown in all figures. For this purpose, reference is made respectively to the other figures.

FIGS. 1-13 show an embodiment of the invention wherein only the parts of the device that are essential for an understanding of the invention are shown in axial half-sections. The items illustrated, arranged one behind the other coaxially with an axis A, are an advancing mechanism 1, a clamping arrangement 2 functioning as immobilising means, a stationary guide 3, a forming die 4, a swaging tool 5 (FIGS. 1-6) and a dishing tool 6 (FIGS. 6-12). A rod material (raw material) identified with R extends coaxially through advancing mechanism 1, clamping arrangement 2 and stationary guide 3.

Stationary guide 3 has a full-length, in this example cylindrical, guide aperture having essentially the same cross-sectional shape as the rod material R that is to be processed, and essentially serves as a guide therefor.

Figure 2:
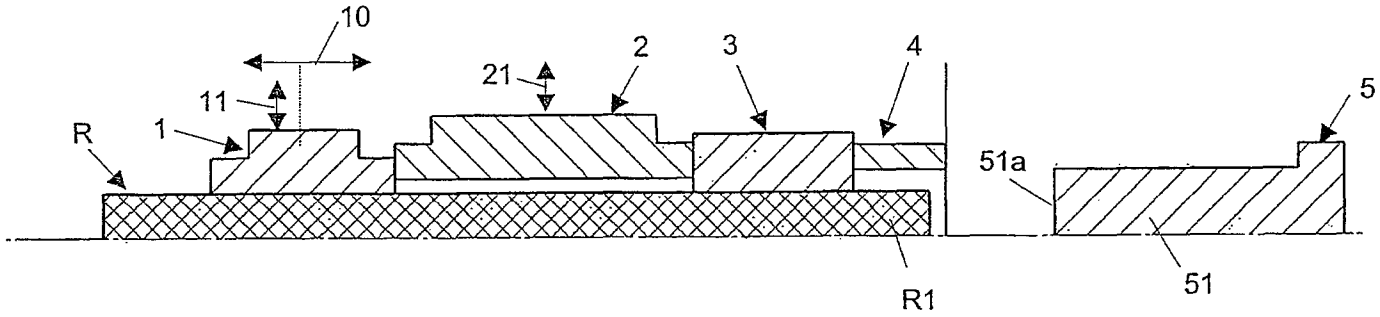
Figure 3:
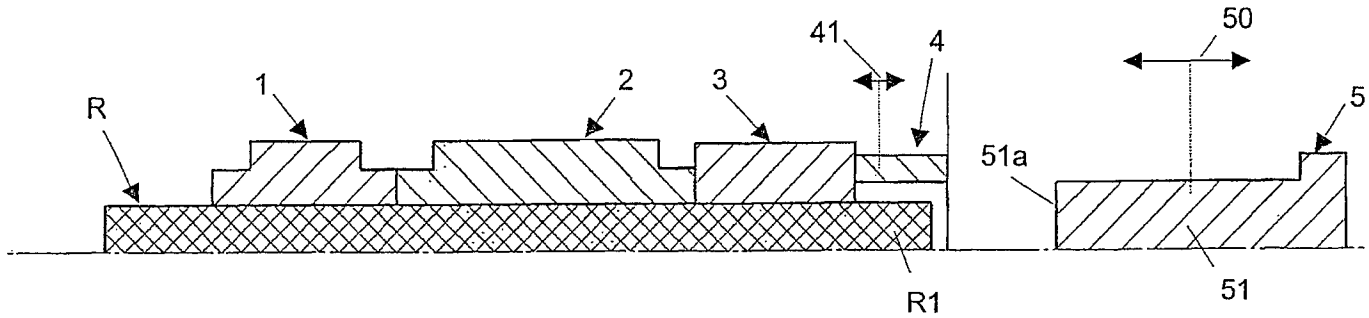
Figure 7:
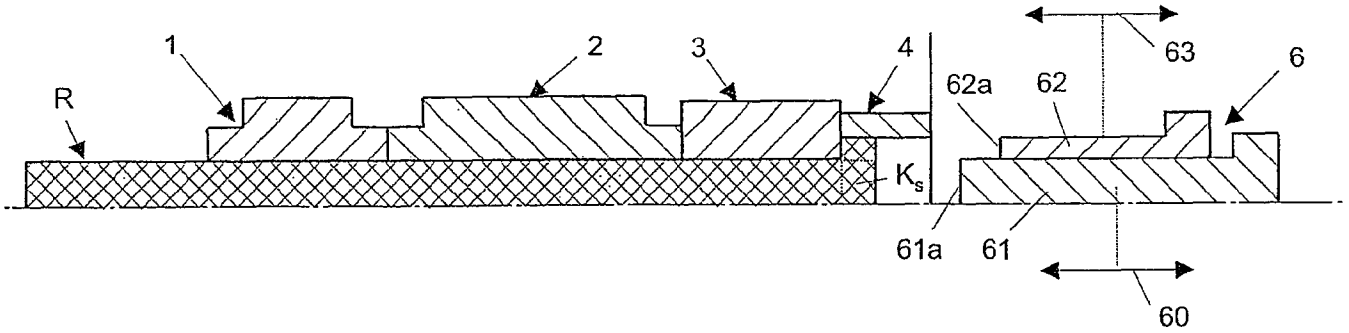

Advancing mechanism 1 as well as swaging tool 5 and dishing tool 6 are axially displaceable by drive means represented symbolically in the drawings by double arrows 10, 50 and 60 (FIGS. 2, 3 and 7). Advancing mechanism 1 is axially displaceable backwards and forwards by the drive means and functions as the advance means for rod material R.

Forming die 4 is designed in the form of a sleeve, and the interior dimensions thereof correspond to the exterior cross-sectional shape of the formed part to be produced. The diameter of its interior space is larger than the diameter of rod material R. Forming die 4 is axially displaceable, as is indicated symbolically by a double arrow 41 in FIG. 3. Forming die 4 is also movable perpendicularly to axis A. This capability will be discussed in detail with reference to FIGS. 12 and 13 below. Swaging tool 5 comprises a header die 51 that has essentially the same cross-sectional shape, particularly the same diameter, as the interior space of sleeve-shaped forming die 4. The frontal face 51*a* of header die 51 is formed flat here.

Dishing tool 6 comprises a dishing punch 61 and a dishing sleeve 62 that is slidable over it coaxially. Dishing punch 61 has essentially the same cross-sectional shape, particularly the same diameter as the rod material R. The external cross-sectional shape of dishing sleeve 62 essentially corresponds to the interior cross-sectional shape of sleeve-shaped forming die 4. The frontal faces 61*a* and 62*a* of dishing punch 61 and dishing sleeve 62 respectively are formed flat here. The relative displacement of dishing sleeve 62 on dishing punch 61 is effected via a drive unit (FIG. 7) represented symbolically by a double arrow 63.

Advancing mechanism 1 has for example two opposing clamping jaws that are adjusted to the external shape of rod material R and can be pressed radially against the rod material (closed) and lifted radially away from the rod material (opened). The advancing mechanism is opened and closed by means of a drive unit that is symbolised in the drawings only by a double arrow 11 (FIG. 2).

Similarly, in a simple embodiment clamping arrangement 2 may preferably be furnished with multiple clamping jaws disposed around rod material R, which together form a kind of chuck, which may also be closed and opened via a drive unit that is indicated symbolically in the drawing only with a double arrow 21 (FIG. 2). A particularly practical and advantageous embodiment of clamping arrangement is described in greater detail later with reference to FIGS. 18-21.

Advancing mechanism 1, clamping arrangement 2, stationary guide 3, the movable, sleeve-like forming die 4, swaging tool 5 and dishing tool 6 are parts of a superordinated forming machine that is equipped in known manner with the driving means for producing the movement sequences still to be described of the device parts indicated, and for generating the requisite forces. This does not need to be explained further to a person skilled in the art.

The method according to the invention is performed in a repeating cycle.

Before the very first method step, and in preparation therefor, rod material R is inserted through open advancing mechanism 1 and open clamping arrangement 2 into stationary guide 3 until the leading frontal face thereof is flush with frontal face 3*a* (FIG. 12) of guide 3. Then, the advancing mechanism is closed (FIG. 1).

With clamping device 2 open, rod material R is now advanced by a predefined distance using the advancing mechanism 1 so that the leading end R1 of rod material R protrudes into forming die 4 (FIG. 2).

Then, clamping arrangement 2 is closed so that rod material R is fixed axially and is also prevented from rotating (FIG. 3).

Figure 4:
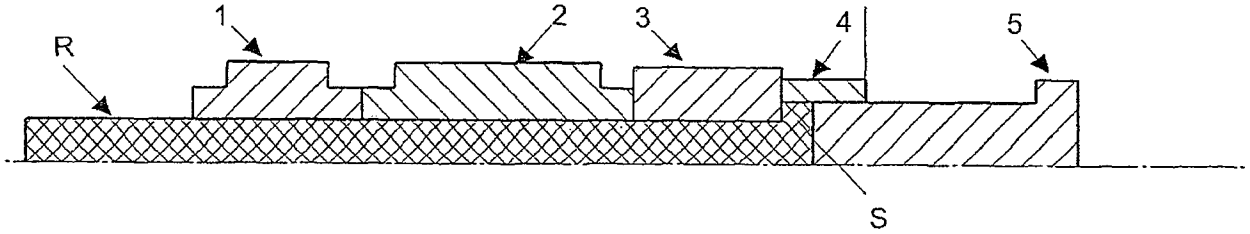
Figure 5:
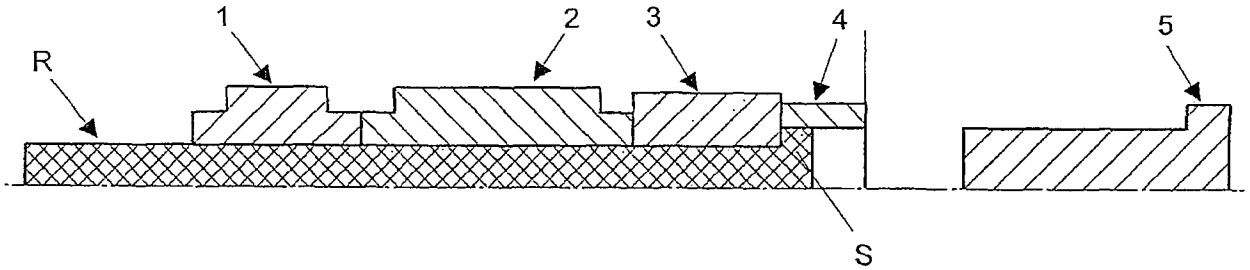

Then, swaging tool 5 is forced against rod material R so that the leading end R1 of the rod material is compressed into a disc S (FIG. 4). Then, swaging tool 5 is retracted again (FIG. 5).

Figure 6:
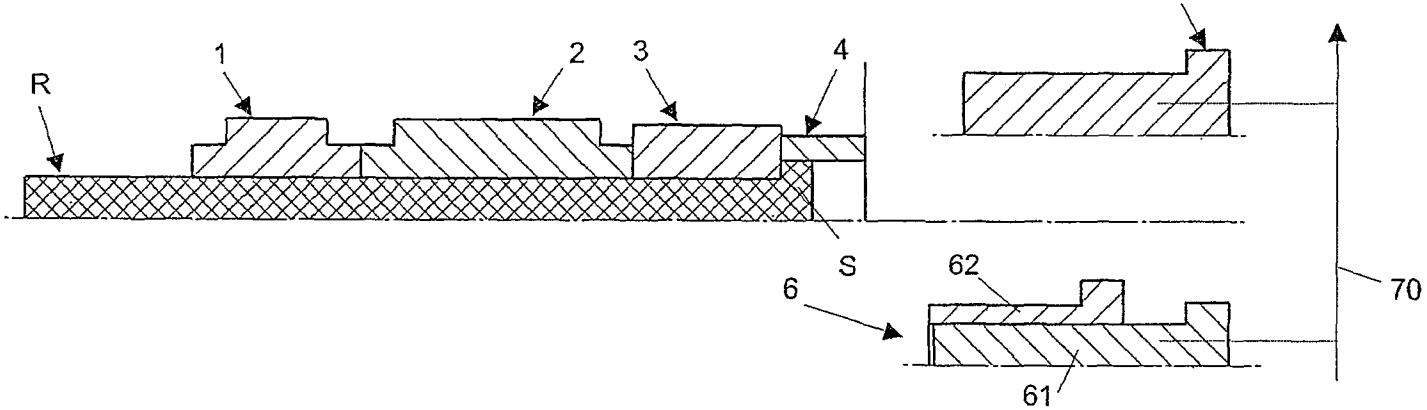

The next operation is to change dies, and swaging tool 5 is replaced with dishing tool 6 (FIG. 6). As will be explained in greater detail later with reference to FIGS. 14 and 15, a die carousel may be provided for this purpose, accommodating both swaging tool 5 and dishing tool 6. The movement for swapping the two tools 5 and 6 and the drive mechanism required for this are symbolised by an arrow 70 in FIGS. 6 and 12.

Figure 8:
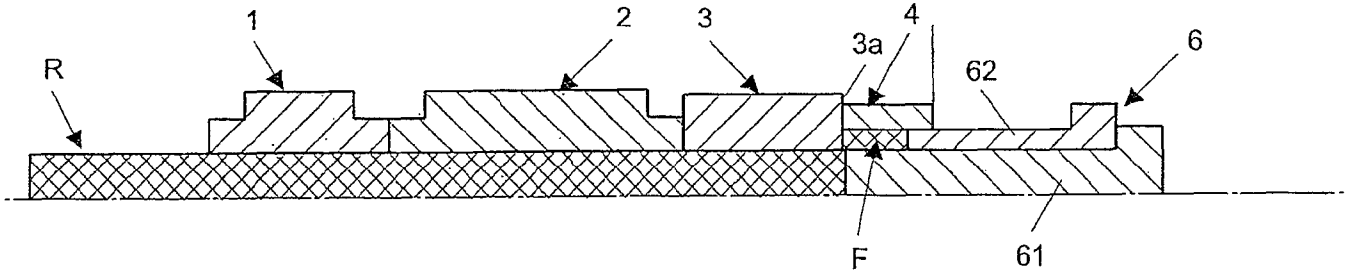

In the next step, dishing tool 6 is moved axially towards rod material R (FIG. 7). As it continues advancing, dishing punch 61 penetrates disc S, thereby initiating an extrusion process. Dishing tool 6 thus functions as a penetration means for axially penetrating disc S. The material of disc core $K_s$ that is displaced by dishing punch 61 is forced into the space between the internal circumferential wall of forming die 4 and the dishing punch 61 during the penetration. When the dishing punch 61 reaches its final position, its frontal face 61*a* is axially just in front of frontal face 3*a* of stationary guide 3 (FIG. 8). The material in forming die 4 forms the formed part F to be formed, which at this stage of the method is still attached to the rest of rod material R via a thin circumferential fin. Axial force is applied to dishing sleeve 62, forcing it towards rod material R and thus creating a compression stress condition in formed part F. The magnitude of the axial compression force is selected such that it assures adequate form filling of the peripheral areas of forming die 4 and in the case of rotationally symmetrical formed parts F that sufficient frictional force is generated at the adjacent walls of forming die 4 and dishing tool 6 to enable the formed part to be separated by torsion.

According to an important aspect of the invention, forming die 4 is constructed so as no to be slightly radially elastic by selection of a suitable material or other measures. As a result, a strong frictional connection is created between forming die 4 and formed part F under pressure on the one hand, and formed part F and dishing punch 61 on the other hand. This strong frictional connection is extremely important for the subsequent process steps.

Figure 9:
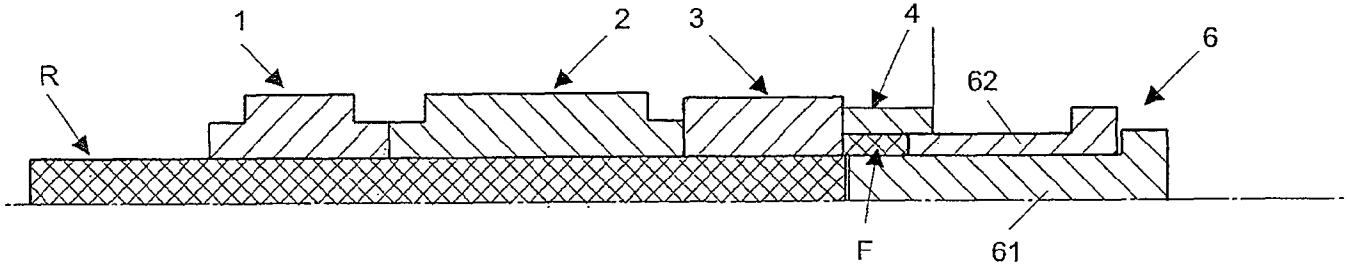

First, dishing punch 61 is retracted a short way, wherein dishing sleeve 62 remains stationary and is exposed to the compression force (FIG. 9). This force is applied by the drive means indicated symbolically with arrow 63 (FIG. 7).

Figure 10:
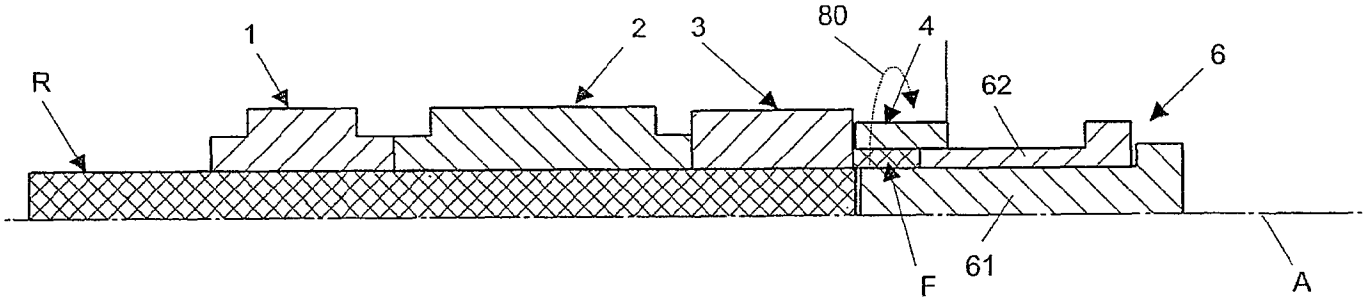
Figure 17:
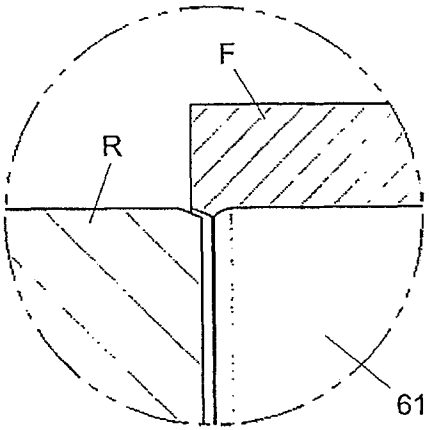
Figure 16:
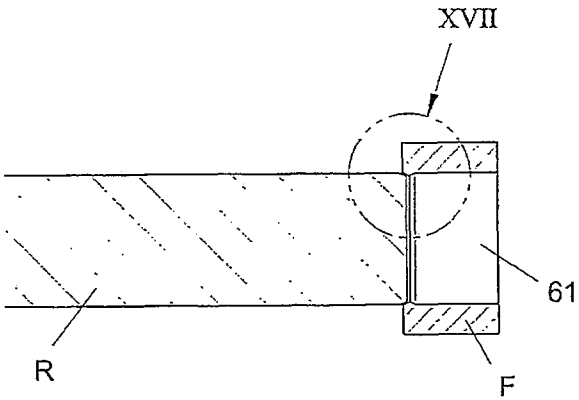
Figure 21:
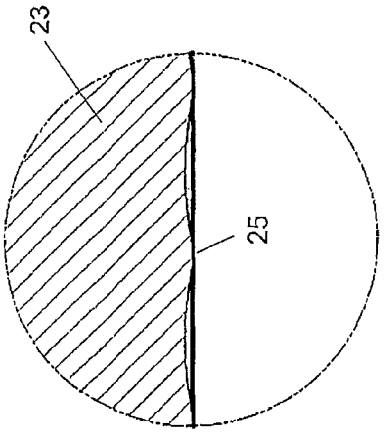
Figure 18:
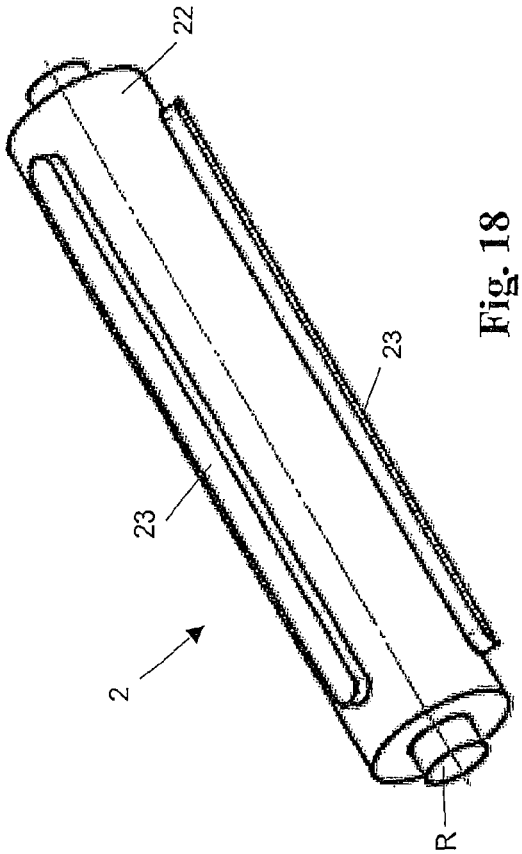
Figure 20:
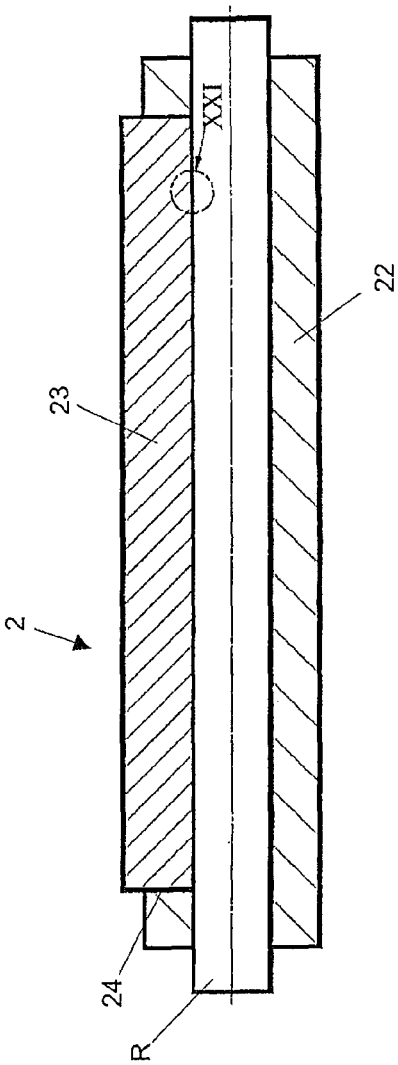
Figure 19:
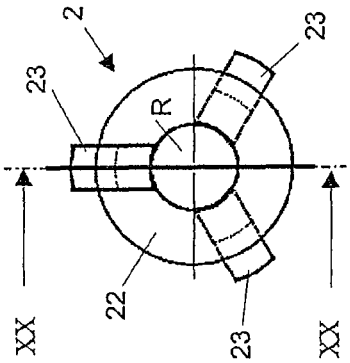

Then, formed part F is separated from the rest of rod material R (FIG. 10). According to one of the most important features of the invention, this separation is effected by torsion shearing. For this, forming die 4 and dishing tool 6 together with the formed part F immobilised by a friction lock between them are rotated about axis A of the (stationary clamped) remainder of rod material R relative thereto. Rotation is provided by a drive means symbolised in the drawing by an arrow 80. During this rotation, the circumferential fin connecting formed part F to the rest of rod material R is sheared off. As is shown in the enlarged details of FIGS. 16 and 17, a slight chamfer is created on the leading end of the rest of rod material R due to torsional shear, but this has considerably less impact on subsequent, further forming processes than the burring that is created by conventional forming and separating. Before the torsion, forming die 4 may also be axially withdrawn slightly, like dishing punch 61, to that it is no longer in contact with frontal face 3*a* of stationary guide 3 and there is less resistance to its rotation.

Figure 11:
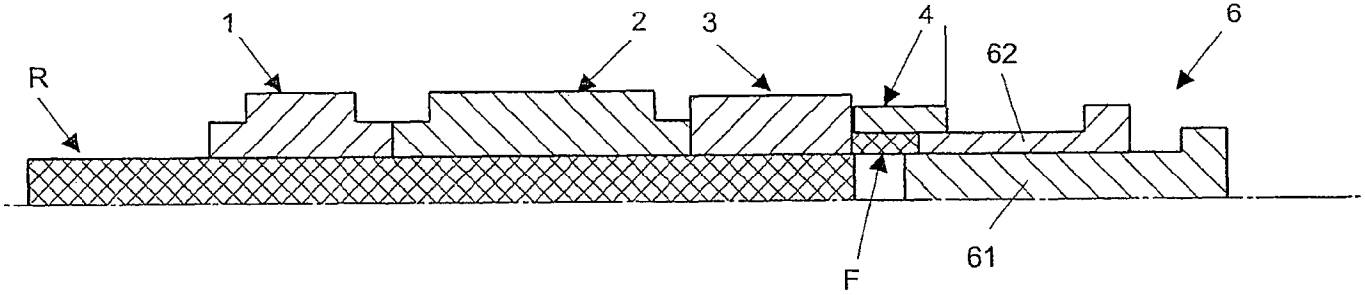
Figure 12:
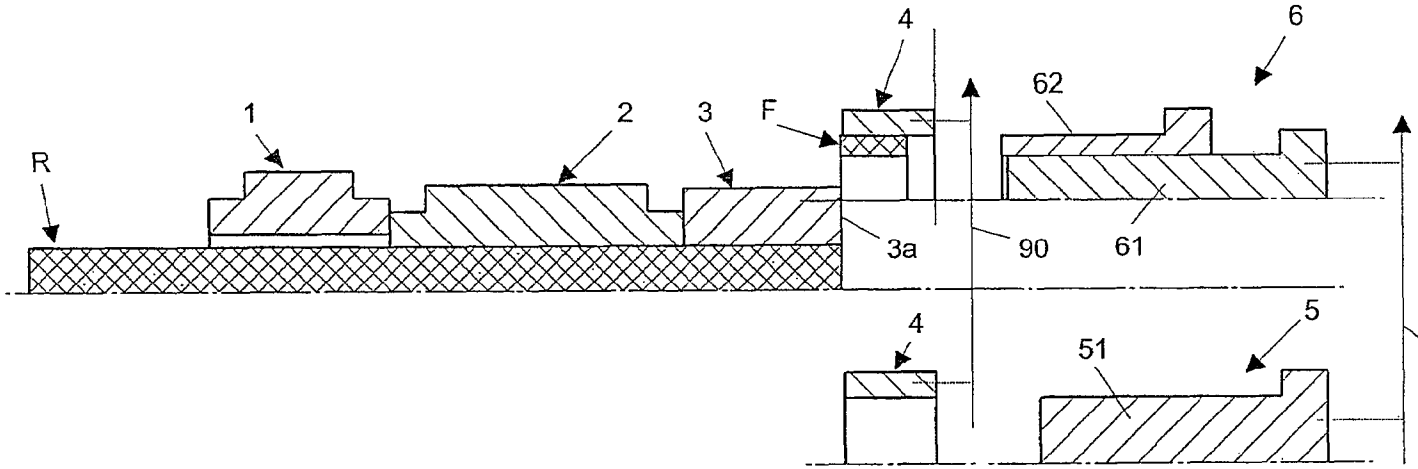

In the next step, dishing tool 6 travels back to its starting position (FIGS. 11 and 12). Then, separated formed part F is transported away from the forming position perpendicularly to the direction of the axis and, for example, conveyed to a subsequent processing station. In this context, formed part F advantageously remains inside forming die 4 and is moved from the forming position together with the die. As is explained in greater detail with reference to FIGS. 14 and 15, a die carousel may be provided to accommodate several forming dies. The movement to remove formed part F (situated in forming die 4) and the drive means required therefor are indicated symbolically by an arrow 90 in FIG. 12. At the same time as the forming die 4 containing the formed part F is removed, it is replaced by a new, empty forming die 4 (FIGS. 12 and 13).

Figure 13:
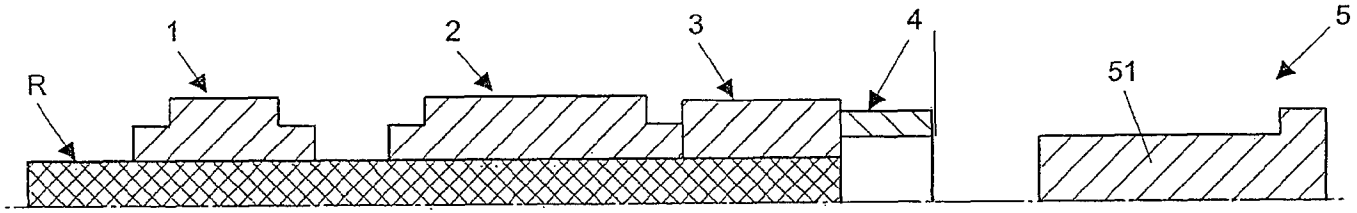

Finally, a die changing operation is also carried out, in which dishing tool 6 is replaced by swaging tool 5 (FIGS. 12 and 13).

In a last step of the method, advancing mechanism 1 is opened and retracted axially by the length of a stroke, then closed again (FIGS. 12 and 13). This completes the process cycle and the device is ready for the next process cycle in accordance with the preceding explanations of FIGS. 1-13. The process cycles are repeated until the remaining length of rod material R is not sufficient for the process to continue.

Figure 14:
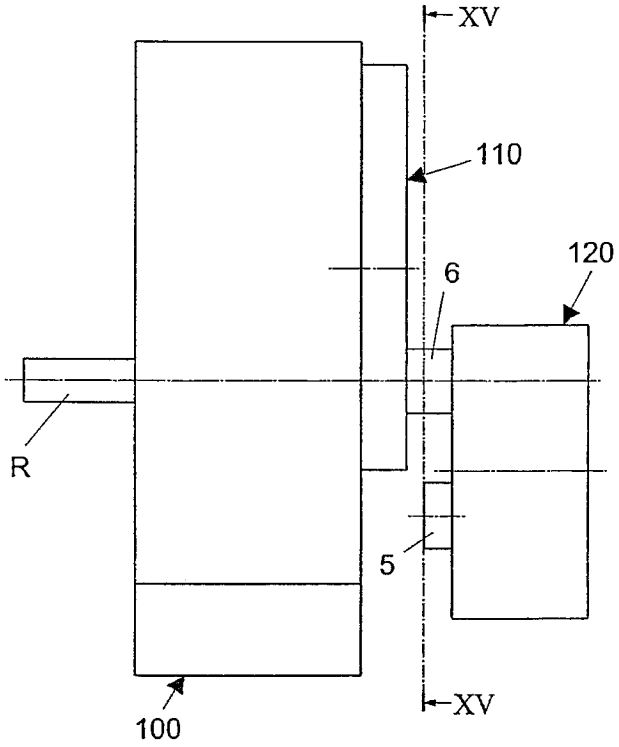
FIG. 14—a schematic side view of the forming components of the device according to the invention, FIG. 15—a schematic axial view along line XV-XV of FIG. 14, FIG. 16—rod material and a formed part formed therefrom in the area of the parting plane, FIG. 17—the enlarged detail XVII from FIG. 16, FIG. 18—a perspective view of a particularly practical design of a clamping arrangement of the device according to the invention, FIG. 19—a schematic cross section perpendicular to the lengthwise axis of the clamping arrangement of FIG. 18, FIG. 20—an axial section through the clamping arrangement along line XX-XX in FIG. 19 and FIG. 21—the enlarged detail XXI from FIG. 20.
Figure 15:
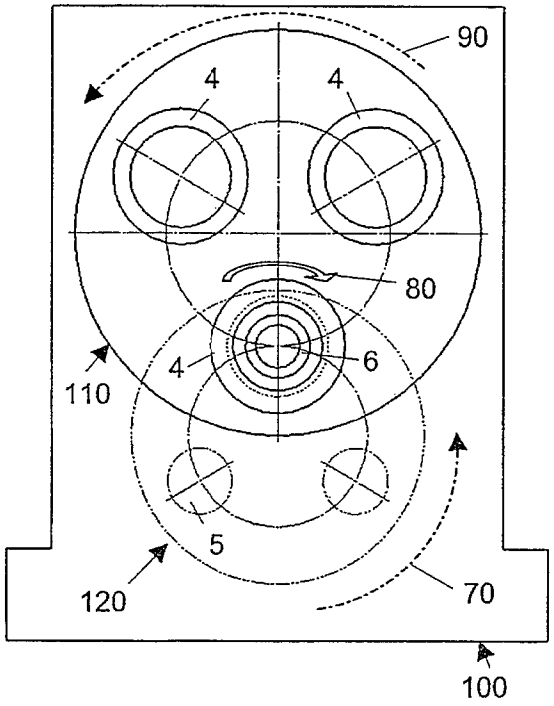

As was indicated previously, swaging tool 5 and dishing tool 6 on one side and forming dies 4 on the other side are advantageously disposed in carousels. FIGS. 14 and 15 illustrate this schematically. A die carousel 110 is supported rotatably in a machine rack 100 and is driven in rotating manner by drive means that are not shown. A rotatable die carousel 120 is arranged axially in front of and at a distance therefrom, and is also driven rotatably by drive means that are not shown. The motion directions for both carousels 110 and 120 and the drive means necessary for the rotary movement are indicated in FIG. 15 by arrows 70 and 90, which were also shown previously in FIGS. 6 and 12. Also as previously in FIG. 10, in FIG. 15, arrow 80 shows how forming die 4 and dishing tool 6 are able to be rotated together with formed part F clamped between them.

As was also mentioned previously, in principle clamping arrangement 2 may be designed in the manner of a chuck, wherein multiple clamping segments engage with the rod material along its circumference. However, chucks of this kind present certain difficulties. In order to be able to apply full clamping force, it is necessary to provide a small gap between the clamping segments, since otherwise the possibility of inconsistent thickness of the rod material, which cannot be ruled out, prevents a defined clamping force from being applied in case the jaws come into contact with each other. In the swaging and dishing operations described above, however, a stress condition is created in the material, extending relatively far in front of the forming zone and forcing this material into the gap that is left between the clamping segments. The material that is squeezed between the longitudinally divided clamping segments is able to impede or even prevent the onward transport of the rod material.

This difficulty, which is particularly critical in hot forming methods, is addressed by the preferred configuration of clamping arrangement 2 as described in the following.

According to this preferred embodiment, clamping arrangement 2 comprises a guide tube 22, the interior dimensions of which match the outer cross-sectional shape of rod material R, and clamping jaws 23 disposed about the circumference and parallel with the axis thereof, which clamping jaws are movable practically without freeplay but radially inwards and outwards in axis-parallel slots 24 in the guide tube 22 such that they may be brought to bear radially on rod material R by the application of external force. The surfaces of the clamping jaws 23 facing towards the rod material R are furnished with friction enhancing structures, for example ribs 25, to increase the clamping effect. With this preferred configuration of the clamping arrangement, the clamping path of the jaws is unrestricted and since the jaws fit practically without freeplay into the slits in the guide tube, it is not possible for a gap to be left through which the material might be forced out.

The invention claimed is:

1. A method for producing a formed part furnished with a through hole, comprising the steps of:

a) advancing a rod material by a defined length in the direction along a longitudinal axis of a lengthwise extension of the rod material into a forming die, wherein an inner circumferential wall of the forming die defines an outer circumference of the formed part to be produced, wherein the rod material is advanced through a stationary guide having the same cross sectional shape as the rod material, b) axially immobilising the rod material, c) axially penetrating and impact extruding the portion of the rod material that is inside the forming die by at least one dishing tool, wherein the displaced material flows between the at least one dishing tool and the inner circumferential wall of the forming die to produce the formed part and to form a strong frictional connection between the forming die and the formed part and between the formed part and the dishing tool, thereby immobilising the formed part by a friction lock between the forming die and the formed part and between the formed part and the dishing tool, d) separating the formed part from the rest of the rod material, wherein the formed part located inside and secured within the forming die is rotated about the longitudinal axis coaxially relative to the rest of the rod material together with the forming die and the at least one dishing tool, the formed part thus being separated from the rest of the rod material, and e) transporting the formed part away.

2. The method according to claim 1, wherein the end portion of the rod material that is located inside the forming die after the rod material has been advanced into the forming die is axially swaged by at least one swaging tool while the rod material is axially immobilised, and is thus shaped into a disc whose circumference is defined by the forming die and which is subsequently penetrated axially by the at least one dishing tool.

3. The method according to claim 1, wherein the portion of the rod material located in the forming die is not fully penetrated by the at least one dishing tool, so that the formed part before separation from the rest of the rod material initially remains attached to the rest of the rod material via a thin circumferential fin.

4. The method according to claim 1, wherein the forming die is constructed so as to be radially elastic.

5. The method according to claim 1, wherein the formed part is subjected to an axial compression force while the formed part is being separated from the rest of the rod material.

6. The method according to claim 1, wherein the rod material is immobilised by a stationary clamping arrangement that can be opened and closed and engages circumferentially with the rod material.

7. The method according to claim 1, wherein the rod material is advanced into the forming die by an advancing mechanism that is movable by driving means backwards and forwards in the longitudinal direction, can be opened and closed, and engages circumferentially with the rod material.

8. The method according to claim 1, wherein the formed part is transported away in the forming die.

9. A device for producing a formed part furnished with a through hole, comprising advancing means and immobilising means for a rod material, a guide for the rod material, a forming die and penetration means for axially penetrating a portion of the rod material that is located in the forming die, and a driving means with which the forming die, the penetration means, and the portion of the rod material contained in the forming die may be rotated, which portion after axial penetration becomes a formed part with a strong frictional connection between the forming die and the penetration means, wherein the formed part which is immobilised by a friction lock between the forming die and the formed part and between the formed part and the penetration means, and the rest of the rod material are rotatable relative to each other, wherein the driving means is rotatable relative to the immobilising means such that by rotation between the driving means and the immobilising means the formed part can be separated from the rest of the rod material by torsion shearing and wherein the penetration means include a dishing tool equipped with a dishing punch and a dishing sleeve surrounding the punch, and the formed part located inside the forming die may be subjected to axial compression forces via the dishing sleeve.

10. The device according to claim 9, further comprising at least one swaging tool for axial swaging and forming an end portion of the rod material located in the forming die.

11. The device according to claim 9, wherein the forming die is constructed so as to be radially elastic.

12. The device according to claim 9, wherein the immobilising means for the rod material include a stationary clamping arrangement that is closable to engage with and is openable to disengage from the rod material in a circumferential direction.

13. The device according to claim 12, wherein the clamping arrangement has a guide tube whose interior dimensions are adapted to the exterior cross-sectional shape of the rod material and clamping jaws arranged parallel to the axis and disposed about the circumference thereof, which clamping jaws are arranged without freeplay, but are movable radially inwards and outwards in axis-parallel slots in the guide tube such that they are brought to bear on the rod material by the application of external force.

14. The device according to claim 9, wherein the forming die is movable away from the guide perpendicularly to the longitudinal extension of the rod material.

15. The device according to claim 9, further comprising a die carousel in which two or more forming dies are accommodated.

16. The method according to claim 3, wherein the portion of the rod material located in the forming die is penetrated only as far as 98-99% of the axial thickness of said portion.

17. The method according to claim 8, wherein the forming die together with the formed part is moved away from the rest of the rod material, first in the direction of and then perpendicularly to the lengthwise extension of the rest of the rod material.

18. The device according to claim 13, wherein the clamping jaws are furnished with friction enhancing structures on the sides of the jaws facing the rod material.

19. The device according to claim 18, wherein the friction enhancing structures are ribs.

* * * * *